United States Patent [19]

Warschewski et al.

[11] Patent Number: 4,842,767

[45] **Date of Patent: * Jun. 27, 1989**

[54] HEAVY DUTY BUILT AQUEOUS LIQUID DETERGENT COMPOSITION CONTAINING STABILIZED ENZYMES

[75] Inventors: D. Warschewski, Spotswood; H. Greenland, Martinsville, both of N.J.

[73] Assignee: Colgate-Palmolive Company, New York, N.Y.

[ * ] Notice: The portion of the term of this patent subsequent to Jun. 27, 2006 has been disclaimed.

[21] Appl. No.: 905,440

[22] Filed: Sep. 10, 1986

[51] Int. Cl.[4] ..... C11D 3/065; C11D 3/33; C11D 3/386

[52] U.S. Cl. ..... 252/525; 252/156; 252/174.12; 252/532; 252/539; 252/551; 252/553; 252/DIG. 12; 435/188

[58] Field of Search ..... 252/174.12, DIG. 12, 252/156, 525, 532, 539, 551, 553; 435/188

[56] References Cited

U.S. PATENT DOCUMENTS

| | | | |
|---|---|---|---|
| 3,296,094 | 1/1967 | Cayle . | |
| 3,320,174 | 5/1967 | Rubinfeld | 252/553 |
| 3,325,364 | 6/1967 | Merritt et al. . | |
| 3,332,876 | 7/1967 | Walker | 252/551 |
| 3,558,498 | 1/1971 | Eymery et al. . | |
| 3,560,392 | 2/1971 | Eymery et al. . | |
| 3,985,687 | 11/1976 | Inamorato et al. | 252/553 |
| 4,115,292 | 9/1978 | Richardson et al. | 252/174.12 |
| 4,238,345 | 12/1980 | Guilbert . | |

FOREIGN PATENT DOCUMENTS

| | | |
|---|---|---|
| 2079305 | 6/1981 | United Kingdom . |

*Primary Examiner*—A. Lionel Clingman
*Assistant Examiner*—Linda D. Skaling
*Attorney, Agent, or Firm*—Norman Blumenkopf; Murray M. Grill

[57] ABSTRACT

A heavy duty built aqueous liquid detergent composition containing a casein stabilized enzyme is provided which comprises 15 to 25% by weight of anionic surface active detergent, 15 to 20% by weight of a polyphosphate builder, 1 to 2% by weight of an enzyme and 2 to 4% by weight of casein.

16 Claims, No Drawings

HEAVY DUTY BUILT AQUEOUS LIQUID DETERGENT COMPOSITION CONTAINING STABILIZED ENZYMES

CROSS REFERENCE TO RELATED APPLICATION

This application is related to copending U.S. application Ser. No. 759,528 filed on July 26, 1985, which is assigned to a common assignee and which discloses an enzyme containing built liquid detergent composition containing defined amounts of surfactant and builder and a defined enzyme stabilizing system comprising glycerine, a boron compound and a polycarboxylic acid compound.

BACKGROUND OF THE INVENTION

This invention relates to built, enzyme-containing liquid detergent compositions suitable for laundry or pre-soak formulations. More particularly, the invention relates to aqueous enzyme-containing liquid detergent compositions which contain one or more detergent builders and which are characterized by being emulsion/dispersions.

The formulation of stabiized enzyme-containing liquid detergent compositions has been the focus of much attention in the prior art. The desirability of incorporating enzymes into detergent compositions is primarily due to the effectiveness of proteolytic and amylolytic enzymes in decomposing proteinaceous and starchy materials found on soiled fabrics, thereby facilitating the removal of stains, such as gravy stains, blood stains, chocolate stains and the like during laundering. However, enzymatic materials suitable for laundry compositions, particularly proteolytic enzymes, are relatively expensive. Indeed, they generally are among the most expensive ingredients in a typical commercial liquid detergent composition, even though they are present in relatively minor amounts. Moreover, enzymes are known to be unstable in aqueous compositions, particularly in aqueous built detergent compositions. It is for this reason that an excess of enzymes is generally required in liquid detergent formulations to compensate for the expected loss of enzyme activity during prolonged periods of storage. The prior art is replete with suggestions for stabilizing enzyme-containing powder and liquid detergent compositions, and in particular unbuilt liquid compositions by the use of various materials which are incorporated into the composition to function as enzyme stabilizers.

In the case of liquid detergent compositions containing a phosphate builder, the problem of enzyme instability is particularly acute. Primarily this is because phosphate detergent builders have a destabilizing effect on enzymes, even in compositions containing enzyme stabilizers which are otherwise effective in unbuilt formulations. Moreover, the incorporation of a phosphate builder into a liquid detergent composition poses an additional problem, namely the ability to form a stable single-phase composition; the solubility of sodium tripolyphosphate, for example, being relatively limited in aqueous compositions, and especially in the presence of anionic detergents.

BACKGROUND OF THE INVENTION

Heavy duty aqueous liquid detergents with greater than 5% TPP are relatively new. The stabilization of enzymes in this type of system is more difficult than with powders containing more than 5% TPP. While it is possible to reduce the pH to improve enzyme stability this negates to some extent the benefit of the builders. The casein stabilizers of the present invention provide enzyme stability even at relatively high pH's, up to pH 10–11. The higher pH's, e.g. pH 10–11, are known to give better detergency and are preferred. Reducing the detergent composition pH, e.g. to pH 7.5 to 9.5 can increase the stability of the enzyme, but reduces suds life and the benefits of the builder, i.e. detergency.

PRIOR ART PATENTS

U.S. Pat. No. 3,325,364 discloses a method for the preparation of stabilized aqueous solutions containing a proteolytic enzyme, proteinaceous materials such as gelatin, casein and collagen, and calcium ion for use in aerosol sprays for topical and parenteral application.

U.S. Pat. No. 3,296,094 discloses stabilized aqueous enzyme solutions suitable for use in meat tenderization processes. The dilute aqueous solutions disclosed comprise enzymes, glycerol and partially hydrolyzed and solubilized collegen (protein).

U.S. Pat. No. 3,558,498 discloses a granular detergent composition containing stabilized enzymes, sodium perborate trihydrate, anhydrous trisodium phosphate, anhydrous calcium sulfate and soluble or dispersible proteins of mol. weight 5000 to 1,000,000, e.g. casein 50,000 to 200,000 mol. wt.

U.S. Pat. No. 3,560,392 (CINP U.S. Pat. No. 3,558,498) discloses a grandular detergent composition containing organic detergent, alkaline builder salt, a stabilized enzyme and a stabilizing amount of protenaceous collagen of average mol. wt. 5,000 to 250,000.

U.S. Pat. No. 4,238,345 discloses a liquid proteolytic enzyme containing detergent composition in which the enzyme is stabilized by adding an antioxidant and a hydrophilic polyol having 2 to 6 hydroxyl groups. Patentee states in column 1 that calcium salts combined with proteins and glycerol combined with proteins have been used to provide enzyme stabilizing systems in aqueous liquid detergents.

U.K. Patent Application No. G.B. 2,079,305 discloses an aqueous built enzyme containing liquid detergent composition which is stabilized by a mixture of a polyol and boric acid.

BRIEF DESCRIPTION OF THE INVENTION

In accordance with the present invention there is provided a heavy duty polyphosphate built aqueous liquid detergent composition containing a proteinaceous stabilizing material, e.g. casein, an enzyme and an anionic surface active detergent. The detergent composition comprises 15 to 35% by weight of anionic surface active detergent, 10 to 25% by weight of a polyphosphate builder, 1 to 4% by weight of an enzyme and 1 to 6% by weight of a protein stabilizer, e.g. casein, for the enzyme.

In accordance with the present invention, laundering of stained and/or soiled fabrics is affected by contacting the fabrics with an aqueous solution of the heavy duty built aqueous liquid detergent composition containing the casein stabilized enzyme.

The aqueous liquid detergent compositions of the present invention are capable of satisfactorily cleaning laundry items containing both oily and particulate soils. Additionally, the described compositions may be employed for the pretreatment of badly soiled areas, such as collars and cuffs, of items to be laundered.

The present invention is predicated upon the discovery that certain proteinaceous materials, e.g. casein, provide an effective and efficient enzyme stabilizing effect to the aqueous liquid detergent compositions of the present invention.

In an embodiment of the present invention there is provided a heavy duty built aqueous liquid detergent composition comprising a casein stabilized enzyme and a suspension of a detergent phosphate builder salt in the aqueous liquid and anionic surfactant detergent.

Applicants have found that certain proteins, e.g. casein, have an enzyme stabilizing effect and that denaturing or unravelling the proteins improves the enzyme stability. The proteins were found to stabilize both liquid and prilled enzymes in phosphate built heavy duty aqueous liquid detergent compositions. The prilled enzymes were found to be more effective than the same enzymes used in liquid form.

The detergent compositions of the present invention is a suspension/ emulsion. The phosphate builder is the suspension part and the anionic surfactant detergent is the emulsion part. The product on standing in a container in storage in some cases may separate into a dispersed lower phase and a clear upper phase. All this is required before use is to shake the container and mix the two phases.

The aqueous liquid detergent composition of the present invention are easily pourable, easily measured and easily put into the washing machine.

The aqueous liquid detergent compositions of the present invention can include one or more other detergent builder salts, nonionic and amphoteric surfactants, physical stabilizing agents, viscosity control agents, anti-encrustation agents, pH control agents, optical brighteners, anti-redeposition agents, perfumes and dyes.

ADVANTAGES OVER THE PRIOR ART

The present invention provides a heavy duty phosphate built aqueous liquid detergent composition containing a simple stabilized enzyme system which comprises a proteineous material, e.g. casein. The enzyme stabilizing system provides stabilization of the active ingredient enzyme over relatively long periods of time such that smaller amounts of the expensive enzymes can be used.

The present invention provides in an aqueous liquid a phosphate built anionic surfactant detergent composition that can be used at effective high pH of 10–11.

DETAILED DESCRIPTION OF THE INVENTION

In accordance with the present invention the activity of the enzyme is stabilized over a relatively long period of time such that smaller amounts of the enzyme provide effective enzyme cleaning activity. The enzyme activity is stabilized by the addition of small effective amounts of proteinaceous material. The stabilized enzyme-proteinaceous material system is used in an aqueous phosphate built anionic detergent composition.

Enzymes

The enzymes to be incorporated in the detergent compositions of the present invention can be proteolytic or amylolytic enzymes or mixtures thereof.

The proteolytic enzymes suitable for the present invention include the various commercial liquid, powdered or prilled enzymes preparations which have been adapted for use in detergent compositions.

Enzyme preparations can be used in powdered, prilled or liquid form. Though the incorporation of the enzyme in the composition is most convenient in liquid form, the enzymes in the prilled form have proven to be the more stable.

Typical prilled enzymes that can be used are Alcalase 2.0T and Esperase 4.0T.

The particle size distribution of the prilled enzymes can be:

| Alcalase 2.0 T | | Esperase 4.0 T |
|---|---|---|
| <10 mesh | 0 wt % | 0 wt % |
| 10–20 mesh | 10 wt % | 12 wt % |
| 20–30 mesh | 33 wt % | 27 wt % |
| 30–40 mesh | 43 wt % | 42 wt % |
| 40–50 mesh | 12 wt % | 18 wt % |
| >50 mesh | 2 wt % | 1 wt % |

The Alcalase enzyme has an activity of 2.0 Anson units/g and the Esparase enzyme has an activity of 4.0 KNPU/g.

The prilled enzymes can be obtained from NOVO Industries of Copenhagen, Denmark.

Suitable liquid enzyme preparations include "Alcalase" and Experase" sold by Novo Industires, Copenhagen, Denmark, and "Maxatase" and "AZ-Protease" sold by Gist-Brocades, Delft, The Netherlands.

Suitable proteolytic enzymes include subtilison, bromelin, papain, trypsin and pepsin. Suitable amylase enzymes include lipase. Preferred enzymes include protease slurry, esperase slurry and amylase slurry. A preferred enzyme is Esperase SL8 which is a protease.

Suitable alpha-amylase liquid enzyme preparations are those sold by Novo Industires and Gist-Brocades under the tradenames "Termamyl" and "Maxamyl", respectively.

"Esperase" 4.0 T is preferred for the present compositions because of its activity at the higher pH values corresponding to the built detergent compositions.

"Alcalase" 4 T is particularly preferred also because of its activity at the higher pH values corresponding to the built detergent compositions.

The enzymes are used in an effective amount depending on their activity of 0.5 to 5.0%, preferably 1 to 4% and more preferably 1 to 2% by weight of the entire detegerent composition.

Proteinaceous Material

The enzyme stabilizing material constituent of the present invention is a proteinaceous material, for example casein.

Proteins which are soluble or dispersible in water are utilized herein in an effective amount to stabilize the enzymes. Examples of proteins which are soluble or dispersible in water and suitable for use herein include casein (average molecular weight 50,000 to 200,000), Wilsons Protein WSP-X-1000 (a solubilized collagen having an average molecular weight of about 10,000) and Wilson's Hydrolyzate Cosmetic 50, both marketed by Wilson's Pharmaceutical & Chemical Company and Collagen Hydrolyzate Cosmetic 50, marketed by Maybrook, Inc.

A preferred casein protein is Product 44016, having an estimated molecular weight of 350,000 to 400,000, marketed by BDH Chemicals Ltd., Poole, England.

An analysis of the Product 44016 is as follows:

| | | |
|---|---|---|
| $N_2$ in dried material | 13.5–15.5 | wt % |
| pH (2% solution) | 6–8 | wt % |
| Sulfated ash | 3–6 | wt % |
| Moisture | 5 (max) | wt % |
| Fat | 1.5 (max) | wt % |

The proteins, e.g. casein, are normally available as powders. The proteins such as casein exist as long chemcial chains. As powders the chains are folded upon themselves and form hydrogen bonds holding the protein in a globular form.

Unravelling or denaturing the protein involves rupturing these bonds to form a looser more random structure. The proteins can be denatured by boiling in water, or by the addition of acids, alkalis and various detergents. A preferred method of denaturing the proteins is simply by boiling in water for 5 to 20 minutes, e.g. about 10 minutes. The unravelled or denatured proteins provide better enzyme stability. The denaturing makes the protein more effective as a stabilizer.

The protein, e.g. casein, is used in an amount sufficient to effect stabilization of the enzyme activity. The protein can be used in an amount of 1 to 8% preferably 1 to 6% and more preferably 2 to 4% by weight based on weight of the entire detergent composition.

The protein is incorporated in the detergent composition by first mixing the protein with the enzyme to form an aqueous solution or slurry and then adding the mixture to the detergent composition. The weight ratio of protein to enzyme that can be used 6:1 to 1:1, preferably 4:1 to 1:1 and more preferably 3:1 to 1:1.

Surface Active Detergents

The laundry detergent composition may contain one or more surface active agents selected from the group consisting of anionic and nonionic detergents. The preferred surfactant detergents for use in the present invention are the synthetic anionic detergent compounds and particularly higher alkyl benzene sulfonates and higher alkyl sulfonates and mixtures thereof. The anionic detergents may be supplemented, if desired, with nonionic detergents.

Anionic Surfactant Detergents

The anionic surface active agents that are useful in the present invention are those surface active compounds which contain a long chain hydrocarbon hydrophobic group in their molecular structure and a hydrophile group, i.e. water solubilizing group such as solfonate or sulfate group. The anionic surface active agents include the alkali metal (e.g. sodium and potassium) water soluble higher alkyl benzene sulfonates, alkyl sulfonates, alkyl sulfates and the alkyl poly ether sulfates. The preferred anionic surface active agents are the alkali metal higher alkyl benzene sulfonates and alkali metal higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 10 to 16 carbon atoms and more preferably 12 to 15 carbon atoms. A particularly preferred alkyl benzene sulfonate is the sodium or potassium tridecyl benzene sulfonate, e.g. sodium linear tridecylbenzene sulfonate. The primary and secondary alkyl sulfonates can be made by reacting long chain alpha-olefins with sulfites or bisulfites, e.g. sodium bisulfite. The alky sulfonates can also be made by reacting long chain normal paraffin hydrocarbons with sulfur dioxide and oxygen as described in U.S. Pat. Nos 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined to the 2-carbon atoms of the chain, i.e. may be a secondary sulfonate. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 4 to 32%, preferably 10 to 22% and more preferably 10 to 16% by weight.

The alkali metal alkyl sulfonate can be used in admixutre with the alkylbenzene sulfonate in an amount of 5 to 15%, preferably 10 to 15% by weight.

The higher alkyl polyehter sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkly poly ethoxy sulfates used in accordance with the present invention are represented by the formula $$R^1—O(CH_2CH_2O)_p—SO_3M,$$

where $R^1$ is a $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, and ammonium cation. The sodium and potassium salts are preferred.

A preferred higher alkyl poly ethoxylated sulfate is the sodium salt of a triethoxy $C_{12}$ to $C_{15}$ alcohol sulfate having the formula $$C_{12\text{-}15}—O—(CH_2CH_2O)_3—SO_3Na.$$

Examples of suitable higher alkyl poly lower alkoxy sulfates that can be used in accordance with the present invention are $C_{12\text{-}15}$ normal or primary alkyl triethenozy sulfate, sodium salt; n-decyl diethenoxy sulfate, sodium salt; $C_{12}$ primary alkyl diethenoxy sulfate, ammonium salt; $C_{12}$ primary alkyl triethoxy sulfate, sodium salt; $C_{15}$ primary alkyl tetraethenoxy sulfate, sodium salt, mixed $C_{14\text{-}15}$ normal primary alkyl mixed tri- and tetraethenoxy sulfate, sodium salt; stearyl pentaethenoxy sulfate, sodium salt; and mixed $C_{10\text{-}18}$ normal primary alkyl triethenozy sulfate, potassium salt.

The normal alkyl poly-lower alkoxy sulfates are readily biodegradable and are prefered. The alkyl poly-lower alkoxy sulfates can be used in mixtures with each other and/or in mixtures with the above discussed higher alkyl benzene and higher alkyl sulfonates.

The alkali metal higher alkyl poly ethoxylated sulfate can be used with the alkylbenezne sulfonate and/or with the alkyl sulfonate, in an amount of 1 to 10%, preferably 2 to 8% and more preferably 2 to 5% by weight of entire composition.

Nonionic Surfactant Detergent

The nonionic synthetic organic detergents can be used to replace a part of the anionic surfactant detergents.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moeity. A preferred class of the nonionic detergent employed is the poly-lower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mol.

Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide group present averages about 6.5. The higher alcohols are primary alkanols.

Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include Product A (a $C_{13}$–$C_{15}$ fatty alcohol condensed with 6 moles ethylene oxide and 3 moles propylene oxide), Product B (a $C_{13}$–$C_{15}$ fatty alcohol condensed with 7 moles propylene oxide and 4 moles ethylene oxide), Product C (a $C_{13}$–$C_{15}$ fatty alcohol condensed with 5 moles propylene oxide and 10 moles ethylene oxide), and Product D (a mixture of equal parts Product C and Product B).

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ secondary fatty alcohols with relatively narrow contents of ethylene oxide in the range of from about 7 to 9 moles, and the C9 to C11 fatty alchols ethoxylated with about 5–6 moles ethylene oxide.

Mixtures of two or more of the liquid nonionic surfactants can be used.

Builder Salts

The liquid aqueous anionic or anionic and nonionic surfactant used in the compositions of the present invention has dispersed and suspended therein fine particles of inorganic and/or organic detergent builder salts.

The invention detergent compositions include water soluble and/or water insoluble detergent builder salts. Water soluble inorganic alkaline builder salts which can be used alone with the detergent compound or in admixture with other builders are alkali metal carbonates, bicarbonates, borates, phosphates, polyphosphates, and silicates. (Ammonium or substituted ammonium salts can also be used.) Specific examples of such salts are sodium tripolyphosphate, sodium carbonate, sodium pyrosphosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred.

The polyphosphate builder (such as sodium tripolyphosphate) can be supplemented with suitable organic auxiliary builders.

Suitable organic builders are polymers and copolymers of polyacrylic acid and polymaleic anhydride and the alkali metal salts thereof. More specifically such builder salts can consist of a copolymer which is the reaction product of about equal moles of methacrylic acid and maleic anhydride which has been completely neutralized to form the sodium salt thereof. The builder is commercially availabe under the trandname of Sokalan CP5. This builder serves when used even in small amounts to inhibit incrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA), and triethanolammonium N-(2-hydroxyethyl)nitrilodiacetates. Mixed salts of these aminopolycarboxylates are also suitable.

Other suitable builders of the organic type include carboxylmethylsuccinates, tartronates and glycollates. Of special value are the polyacetal carboxylates. The polyacetal carboxylates and their use in detergent compositions are described in U.S. Pat. Nos. 4,144,226, 4,315,092 and 4,146,495.

The inorganic alkali metal silicates are useful builder salts which also function to adjust or control the pH and to make the composition anticorrosive to washing machine parts. Sodium silicates of $Na_2O/SiO_2$ ratios of from 1.6/1 to 1/3.2, especially about 1/2 to 1/2.8 are preferred. Potassium silicates of the same ratios can also be used.

The water insoluble crystalline and amorphour aluminosilicate zeolite builders can be used. The zeolites generally have the formula $(M_2O)_x \cdot (Al_2O_3)_y \cdot (SiO_2)_z \cdot wH_2O$ wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 miliequivalents per gram or greater, e.g. 400 meq lg.

Various crystalline zeolites (i.e. alumino-silicates) that can be used are described in British Pat. No. 1,504,168, U.S. Pat. No. 4,409,136 and Canadian Pats. Nos. 1,072,835 and 1,087,477, all of which are hereby incorporated by reference for such descriptions. An example of amorphours zeolites useful herein can be found in Belgium Pat. No. 835,351 and this patient too is incorporated herein by reference.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents contains at least 50% montmorillonite and thus its cation exchange capacity is at least about 50 to 75 meq per 100g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

In addition to the detergent builders, various other detergent additives or adjuvants may be present in the detergent product to give it additional desired properties, either of functional or aesthetic nature.

Thus, improvements in the physical stability and anti-settling properties of the composition may be achieved by the addition of a small effective amount of an aluminum salt of a higher fatty acid, e.g. aluminum stearate, to the composition. The aluminum salt stabilizing agents are the subject matter of the commonly assigned copending application Ser. No. 725,455 filed April 22, 1985. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Optical brighteners for cotton, polyamide and polyester fabrics can be used. Suitable optical brighteners include Tinopal LMS-X, stilbene, triazole and benzidine sulfone compositions, especially sulfonated substituted trianzinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-form agents, e.g. silicon compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxylmethyl cellulose, pH modifiers and pH buffers, color saft bleaches, perfume, and dyes and bluing agents such as Iragon Blue L2D, Detergent Blue 472/572 and ultramarine blue can be used.

The viscosity of the present aqueous liquid detergent composition can be in the range of 500 to 8000 centipoises, preferably 1000 to 4000 centipoises, but products of other suitable viscosities can also be useful.At the viscosities mentioned, the liquid detergent is a stable dispersion/emulsion and is easiy pourable. The pH of the liquid detergent dispersion/emulsion is in the range of 8.6 to 11.5 and preferably 9.5 to 11.5.

In the heavy duty aqueous liquid detergent composition of the present invention, typical proportions (percent based on the total weight of composition, unless otherwise specified) of the ingredients are as follows:

Water in an amount of 30 to 65%, preferably 35 to 60%, and more preferably 40 to 55% by weight.

Enzyme in an amount of 0.5 to 5%, preferably 1 to 4% and more preferably 1 to 2%.

Protein stabilizing material, e.g. casein in an amount of 1 to 8%, preferably 1 to 6% and more preferably 2 to 4%.

Liquid anionic surfactant detergents in an amount of 10 to 40%, preferably 15 to 35% and more preferably 15 to 25% by weight.

Liquid nonionic surfactant detergent in an amount of 0 to 20%, preferably 5 to 15% and more preferably 5 to 10% by weight.

Detergent builder, such as sodium tripolyphosphate (TPP), in an amount of 5 to 30%, preferably 10 to 25% and more preferably 15 to 20% by weight.

Alkali metal carbonate in an amount of 1 to 15%, preferably 3 to 10%, and more preferably 5 to 8%.

Alkali metal silicate in an amount of 0 to 15%, preferably 5 to 15%, and more preferably 5 to 10% by weight.

Physical stabilizing agent, e.g. aluminum stearate in an amount of 0 to 3%, preferably 0.1 to 2.0% and more preferably 0.5 to 1.5% by weight.

Anti-redeposition agent, alkali metal carboxymethyl cellulose in an amount of 0.10 to 3.0%, preferably 0.1 to 2%, for example 0.1 to 1%.

Preservative, e.g. Formalin in an amount of 0.10 to 1.0% preferably 0.10 to 0.5%, for example 0.1 to 0.4% by weight.

Optical brightener in an amount of 0 to 2.0%, preferably 0.25 to 1.0%, for example 0.25 to 0.75% by weight.

Perfume in an amount of 0 to 3.0%, preferably 0.25 to 1.25%, for example 0.30 to 1.0% by weight.

Dye in an amount of 0 to 0.1%, preferably 0.01 to 0.1%, for example 0.02 to 0.08% by weight.

Various of the previously mentioned other conventional additives can optionally be added to achieve the desired function of the added materials.

In the selection of the additives, they will be chosen to be compatible with the enzyme stabilizing function of the protein, e.g. casein and the main active constituents of the detergent composition. In this application, as mentioned above, all proportions and percentages are by weight of the entire formulation or composition unless otherwise indicated.

The heavy duty aqueous liquid detergent compositions of the present invention dispense readily in the water in the washing machine.

In a preferred embodiment of the invention the detergent composition of a typical formulation is formulated using the following named ingredients.

| | % by Weight |
|---|---|
| Water | 40 to 55% |
| Enzyme | 1 to 2% |
| Casein Protein | 2 to 4% |
| Phosphate Builder | 5 to 30% |
| Anionic Surfactant: | |
| Sodium Linear Tridecylbenzene Sulfonate | 10 to 22% |
| Sodium $C_{12}$ Alkyl (3EO) Sulfate | 2 to 8% |
| Sodium Carbonate | 5 to 8% |
| Anti-redeposition Agent, Sodium Carboxy Methyl Cellulose | 0.1 to 1% |
| Preservative, Formalin | 0.1 to 0.4% |
| Optical Brightener | 0.25 to 0.75% |
| Perfume | 0.3 to 1.0% |
| Dye | 0.02 to 0.08% |

The present invention is further illustrated by the following examples.

EXAMPLE 1

A heavy duty aqueous liquid detergent composition is formulated from the following ingredients in the amounts specified.

| | % by Weight |
|---|---|
| Water | 52.20 |
| Sodium Tripolyphosphate (TPP) | 17.0 |
| Sodium Linear Tridecylbenzene Sulfonate(1) | 15.0 |
| Sodium Alkyl Ethoxy Sulfate | 5.0 |
| Sodium Carbonate | 6.0 |
| Sodium Carboxy Methyl Cellulose | 0.14 |
| Enzyme (Esperase 4.0 T)(3) | 1.2 |
| Casein(4) | 2.5 |
| Formalin | 0.20 |
| Tinopal LMS-X | 0.40 |
| Iragon Blue L2D | 0.01 |
| Detergent Blue 472/572 | 0.05 |
| Perfume | 0.30 |
| | 100.00 |

(1)Na LTBS
(2)Na AEOS ($C_{12}$ Alkyl with 3 EO)
(3)Esperase 4.0 T sold by NOVO Industries of Copenhagen, Denmark having an activity of 4.0 KNPU/g (Kilo Novo Protease units/gm).
(4)Casein has a molecular weight of 350,000 to 400,000 and is marketed by BDH Chemicals, Ltd.

The preceeding composition can be prepared by the following procedure: 35.94 parts of deionized water at 40° F. are added to a suitable mixing apparatus equipped with a stirrer. With the stirrer adjusted for medium agitation, a mixture consisting of 6.0 parts sodium carbonate and 0.14 parts sodium carboxy methyl cellulose is incorporated into the water. The stirrer speed is then increased to maximum agitation and 17.0 parts sodium tripolyphosphate are slowly added to the mixing apparatus over a period of 10 to 15 minutes to form a suspension. The agitation speed is then decreased to a slow/medium setting while 15.0 parts of sodium linear tridecylbenzene sulfonate is added. Thereafter the optical brightener/color solution is added consisting of 0.40 parts Tinopal LMS-X(CIBA-GEIGY), 0.06 parts of dye and 5.0 parts of deionized water.

The agitation of the mixture is reduced and 5.0 parts of sodium $C_{12}$ Alkyl (3EO) Sulfate is added to the mixture. There is then added 6.26 parts of deionized water containing 0.20 parts of formalin with continued medium agitation. The 1.2 parts of Esperase 4.0T is added to 2.5 parts of casein with 5 parts deionized water to form a slurry. The Esperase-casein-slurry is slowly added with continuous mixing until the slurry is completed dispersed or dissolved.

EXAMPLE 2

An aqueous phosphate built heavy duty liquid detergent of the Example 1 is prepared. In order to determine the effect of the casein concentration, detergent formulations containing 1.2% enzyme and 0%,%, 2.5%, 4.0% and 6.0% casein are prepared. Appropriate adjustments are made to the water content of the formulation. An addition formulation at 4.0% casein concentration is prepared with denatured or unravelled casein. Tests are carried at 35° C. over an aging period of 26 days. The percent activity of the enzyme is determined after 1, 7, 14, 18, 21 and 26 days. The results obtained are reported in the following Table 1.

| Day | 0 | 1 | 7 | 14 | 18 | 21 | 26 |
|---|---|---|---|---|---|---|---|
| Casein Conc. | | | | | | | |
| 0 | 100% | 41% | 4% | 1% | — | — | — |
| 1 | 100% | 55% | 45% | 8% | 0% | — | — |
| 2.5 | 100% | 77% | 94% | 52% | 18% | 32% | 34% |
| 4 | 100% | 81% | 62% | 37% | 18% | 21% | 18% |
| 4* | 100% | 78% | 65% | 77% | 38% | 42% | 27% |
| 6 | 100% | 67% | 65% | 54% | 19% | 38% | 30% |

*This test is with 4% denatured casein. The denatured casein is prepared by boiling in water for about 10 minutes.

The concentrations are in weight percent based on entire detergent formulation. The enzyme in each test is 1.2% Esperase 4.0T.

The data show that the casein effectively stabilizes the enzymes in the phosphate built heavy duty aqueous liquid detergent composition. The 4% denatured casein concentration formulation is more effective in stabilizing the enzyme's activity than the "natural" casein, i.e. the not denatured casein.

EXAMPLE 3

In order to determine the effect of using prilled enzymes and liquid enzymes, tests are carried out using the formuation of Example 1 containing 1.2% of enzyme (Esperase 4.T%) in liquid or prilled form with or without 2.5% casein. The prilled enzymes are obtained from NOVO Industries of Copenhagen, Denmark. The tests are carried out at 35° C. over an aging period of 34 days. The percent activity of the enzyme is determined after 1, 6, 13, 21, 26 and 34 days. The results are reported in the following Table 2.

| Day Test | 0 | 1 | 6 | 13 | 21 | 26 | 34 |
|---|---|---|---|---|---|---|---|
| Formulation | | | | | | | |
| 1 | 100% | 82% | 44% | 34% | 39% | 38% | 21% |
| 2 | 100% | 90% | 67% | 57% | 23% | 30% | 12% |
| 3 | 100% | 72% | 54% | 14% | 12% | 11% | 11% |
| 4 | 100% | 53% | — | 0% | — | — | — |

Formulation
1 Prilled Enzyme + 2.5% Casein.
2 Liquid Enzyme + 2.5% Casein.
3 Prilled Enzyme, no Casein.
4 Liquid Enzyme, no Casein.

The data show that the prilled enzyme with the casein is more stable than the liquid enzyme with the casein and that both the prilled and liquid enzyme stabilized with casein perform better than the prilled or liquid enzyme without casein.

It is understood that the foregoing detailed description is given merely by way of illustration and that variations may be made therein without departing from the spirit of the invention.

What is claimed is:

1. A heavy duty built aqueous liquid detergent composition containing a protein stabilized enzyme which composition comprises an effective amount of an enzyme in an amount of 0.5 to 5%, a sufficient amount of an enzyme stabilizing proteinaceous material selected from the group consisting of casein and collagen to stabilize the enzyme against loss of enzyme activity in an amount of 1 to 8%, an alkali metal phosphate builder salt in an amount of 5 to 30%, and at least one of an anionic, nonionic or mixture of anionic and nonionic surfactant detergents in an amount of 10 to 40%, wherein said composition has a pH of 9.5–11.5.

2. The liquid detergent composition of claim 1 wherein said surface active agent comprises anionic surfactant detergent.

3. A liquid detergent composition containing a protein stabilized enzyme which composition comprises an anionic surfactant in an amount of 15 to 35% by weight, an alkali metal tripolyphosphate builder salt in an amount of 10 to 25% by weight, and wherein said protein stabilized enzyme consists essentially of an effective amount of an enzyme in an amount of 1–4% by weight and a sufficient amount of enzyme stabilizing proteinaceous material selected from the group consisting of casein and collagen to stabilize the enzyme against loss of enzyme activity in an amount of 1–6% by weight, wherein said composition has a pH of 9.5–11.5.

4. The liquid detergent composition of claim 3 wherein said enzyme is at least one of a proteolytic enzyme and an amylolytic enzyme or a mixture thereof.

5. The liquid detergent composition of claim 3 wherein said enzyme is a prilled enzyme.

6. The liquid detergent composition of claim 3 wherein said enzyme is at least one of a protease enzyme and an alpha-amylase enzyme, or a mixture thereof.

7. The liquid detergent composition of claim 3 wherein said enzyme stabilizng proteinaceous material is casein.

8. The liquid detergent composition of claim 3 wherein said enzyme stabilizng proteinaceous material is casein having a molecular weight of about 350,000 to 400,000.

9. The liquid detergent composition of claim 3 wherein said enzyme stabilizing proteinaceous material is unravelled or denatured casein.

10. The liquid detergent composition of claim 3 wherein said anionic detergent comprises an alkali metal linear tridecyl benzene sulfonate and an alkali metal alkyl poltethoxy sulfate.

11. A heavy duty built aqueous liquid detergent composition containing a protein stabilized enzyme which composition comprises,

| | % by weight |
|---|---|
| (a) an effective of an enzyme in an amount | 1 to 2% |
| (b) a sufficient amount of an enzyme stabilizing proteinaceous material casein in an amount of | 2 to 4% |
| (c) anionic surfactant detergent comprising: | |
| (i) sodium linear tridecyl benzene sulfonate in an amount of | 10 to 22% |
| (ii) sodium linear $C_{12}$ Alkyl (3 EO) sulfate | 2 to 8% |
| (d) sodium carbonate in an amount of | 5 to 8% |
| (e) sodium carboxymethyl cellulose in an amount of | 0.1 to 1% |
| (f) formalin preservative in an amount of | 0.1 to 0.4% |
| (g) optical brightener in an amount of | 0.25 to 0.75% |

wherein said composition has a pH of 9.5–11.5.

12. A method for cleaning soiled fabrics which comprises adding to an aqueous wash liquor the heavy duty built aqueous liquid detergent composition of claim 1 in a sufficient amount to clean soiled fabrics.

13. A method for cleaning soiled fabrics which comprises adding to an aqueous wash liquid the heavy duty built aqueous liquid detergent composition of claim 3 in a sufficient amount to clean soiled fabrics.

14. A method for cleaning soiled fabrics which comprises adding to an aqueous wash liquor the heavy duty built aqueous liquid detergent composition of claim 11 in an amount sufficient to clean soiled fabrics.

15. A heavy duty built aqueous liquid detergent composition containing a protein stabilized enzyme which composition comprises an effective amount of an enzyme in an amount of 1 to 2%, a sufficient amount of an enzyme stabilizing proteinaceous material selected from the group consisting of casein and collagen to stabiize the enzyme against loss of enzyme activity in an amount of 2 to 4%, an alkali metal phosphate builder salt in an amount of 10 to 25%, and a surfactant detergent in an amount of 15 to 35%, wherein said composition has a pH of 9.5–11.5.

16. A heavy duty built aqueous liquid detergent composition containing a protein stabilized enzyme which composition comprises an alkali metal phosphate builder salt in an amount of 10 to 25%, and a surfactant detergent in an amount of 15 to 35%, wherein said protein stabilized enzyme consists essentially of an effective amount of an enzyme in an amount of 1–2%, and a sufficient amount of enzyme stabillzing proteinaceous material selected from the group consisting of casein and collagen to stabilize the enzyme against loss of enzyme activity in an amount of 2 to 4%, wherein said composition has a pH of 9.5–11.5.

* * * * *